US007014379B2

(12) United States Patent
Cheng

(10) Patent No.: US 7,014,379 B2
(45) Date of Patent: Mar. 21, 2006

(54) ADJUSTABLE DUAL SLEEVE PEN HOLDING AUXILIARY DEVICE

(76) Inventor: Dido Cheng, Trade mart 4C-27, Taipei World Trade Center, No. 5, Sec. 5, Sinyi Rd., Sinyi District, Taipei City 110 (TW)

( * ) Notice: Subject to any disclaimer, the term of this patent is extended or adjusted under 35 U.S.C. 154(b) by 0 days.

(21) Appl. No.: 10/878,006

(22) Filed: Jun. 29, 2004

(65) Prior Publication Data

US 2005/0286962 A1 Dec. 29, 2005

(51) Int. Cl.
*A46B 5/02* (2006.01)
*A45C 13/22* (2006.01)

(52) U.S. Cl. ..... 401/6; 16/430

(58) Field of Classification Search ..... 401/6, 401/52, 195; D19/47–51; 16/430
See application file for complete search history.

(56) References Cited

U.S. PATENT DOCUMENTS

| | | | | |
|---|---|---|---|---|
| 141,287 | A * | 7/1873 | Orndorff | 15/443 |
| 1,291,972 | A * | 1/1919 | McGuigan | 401/88 |
| 1,376,115 | A * | 4/1921 | Record | 401/6 |
| 2,488,179 | A * | 11/1949 | Engel, Jr. | 401/54 |
| 6,296,409 | B1 * | 10/2001 | Cherry et al. | 401/6 |

* cited by examiner

*Primary Examiner*—David J. Walczak
(74) *Attorney, Agent, or Firm*—Rosenberg, Klein & Lee

(57) ABSTRACT

A pen holding auxiliary device not only provides comfortable touches but also the distance between the sleeves is adjustable to fit users' hands of different sizes. The device mainly comprises a front sleeve, a back sleeve and a length adjustable element. The front sleeve slidably embraces a shaft of the pen for being placed between finger tips. The back sleeve slidably embraces the shaft of the pen for being placed against a part of the hand between a thumb and an index finger thereof. The length adjustable element surrounds the shaft of the pen and connects the front sleeve with one end and connects the back sleeve with the other end.

12 Claims, 8 Drawing Sheets

ADJUSTABLE DUAL SLEEVE PEN HOLDING AUXILIARY DEVICE

TECHNICAL FIELD

This invention relates generally to a pen holding auxiliary device, in particular, an adjustable dual sleeve pen holding auxiliary device wherein the sleeves provides comfortable touches and the distance between the sleeves is adjustable to fit users' hands of different sizes.

BACKGROUND OF THE INVENTION

Pen has been used by human being for writing purposes for a long time. After a long time writing, a user feels sore or uncomfortable at his/her finger tips and a part of his/her hand between the thumb and index finger thereof because of the long time rubs between the pen and the finger tips and the pen between the part of his/her hand between the thumb and index finger thereof.

A conventional pen holding auxiliary device is made of one piece flexible material such as rubber or silica gel. The device has an elongated configuration having a channel therethrough. The device is placed to embrace the shaft of a pen. The device has a first portion for being placed between finger tips such as finger tips of thumb, index finger and middle finger and a second portion for being placed against a part of a user's hand between his/her thumb and index finger. Therefore the device provides comfortable touches between the pen and the hand thereby the user can continue a long time writing. However, the distance between the first portion and the second portion is constant. Accordingly the device cannot fit users' hands of different sizes. The second portion of the device is not in the proper position to provide cushion effect to the part of his/her hand between the thumb and the index finger when the user has bigger or smaller hands. For instances, a pen holding auxiliary device for children doesn't fit the same purpose for adults. It's not economic and practical to produce pen holding auxiliary devices with different lengths. Accordingly, it would be very desirable to have a pen holding auxiliary device not only providing comfortable touches but also the length thereof is adjustable to fit users' hands of different sizes.

SUMMARY OF INVENTION

It is therefore an objective of the present invention to provide a pen holding auxiliary device not only providing comfortable touches but also the distance between the sleeves is adjustable to fit users' hands of different sizes.

The present invention, briefly summarized, in one embodiment discloses an adjustable dual sleeve pen holding auxiliary device for a user to firmly hold a pen. The device mainly comprises a front sleeve, a back sleeve and a length adjustable element. The front sleeve slidably embraces a shaft of the pen for being placed between finger tips. The back sleeve slidably embraces the shaft of the pen for being placed against a part of the hand between a thumb and an index finger thereof. The length adjustable element surrounds the shaft of the pen and connects the front sleeve with one end and connects the back sleeve with the other end.

BRIEF DESCRIPTION OF DRAWINGS

The invention will be more clearly understood after referring to the following detailed description read in conjunction with the drawings wherein.

DETAILED DESCRIPTION OF PREFERRED EMBODIMENTS

Figure 1:
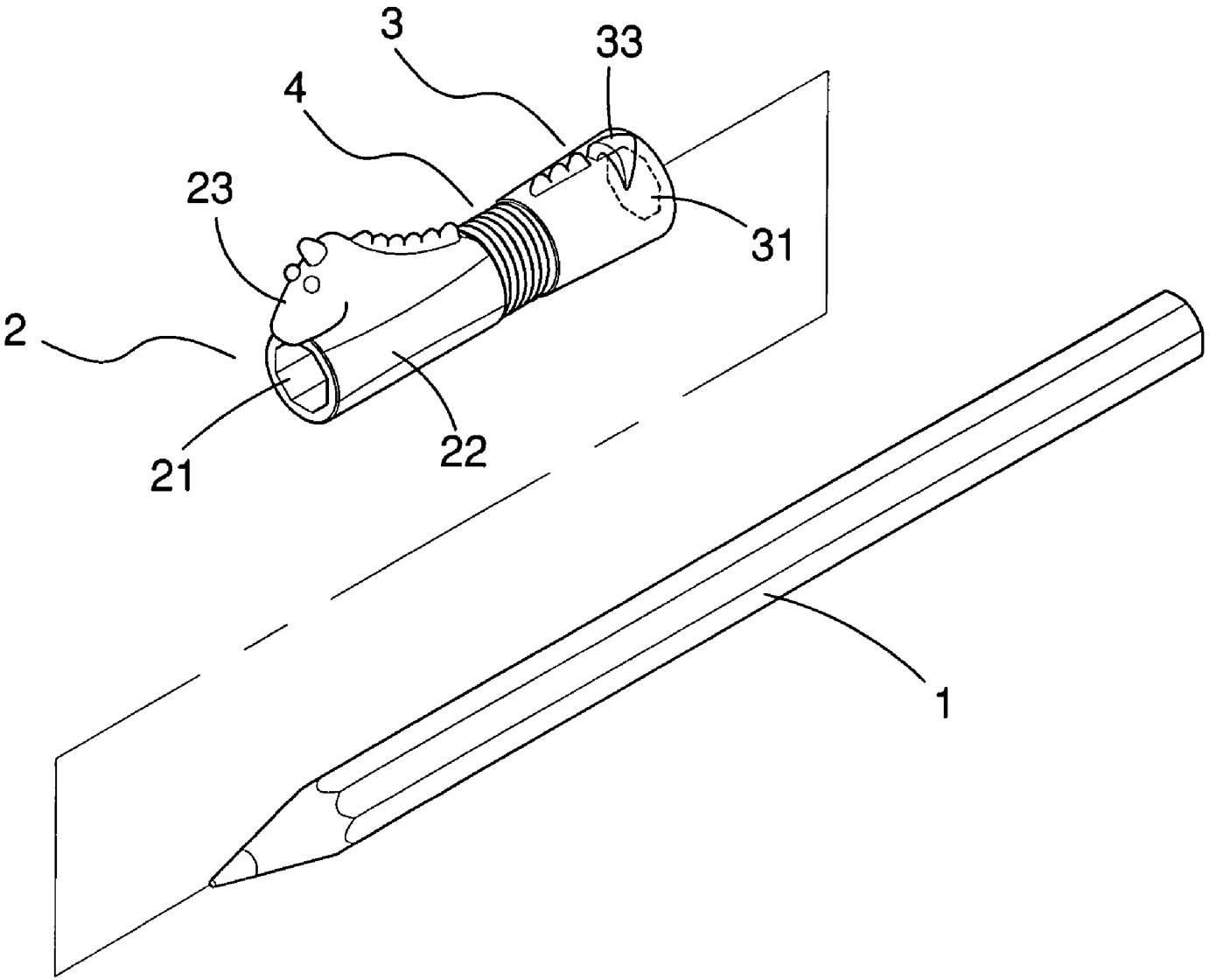
FIG. 1 is an exploded view of the first embodiment.
Figure 2:
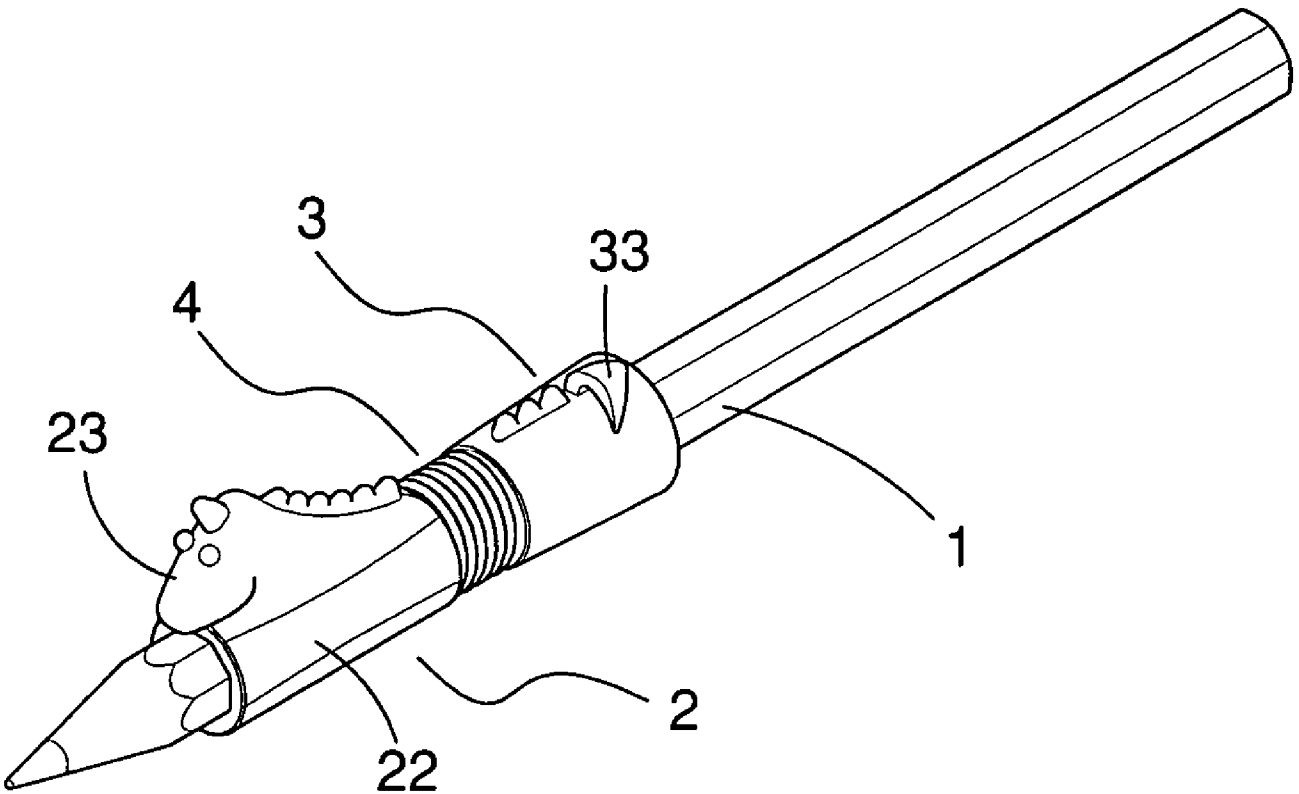
FIG. 2 is a perspective view of the first embodiment.
Figure 3:
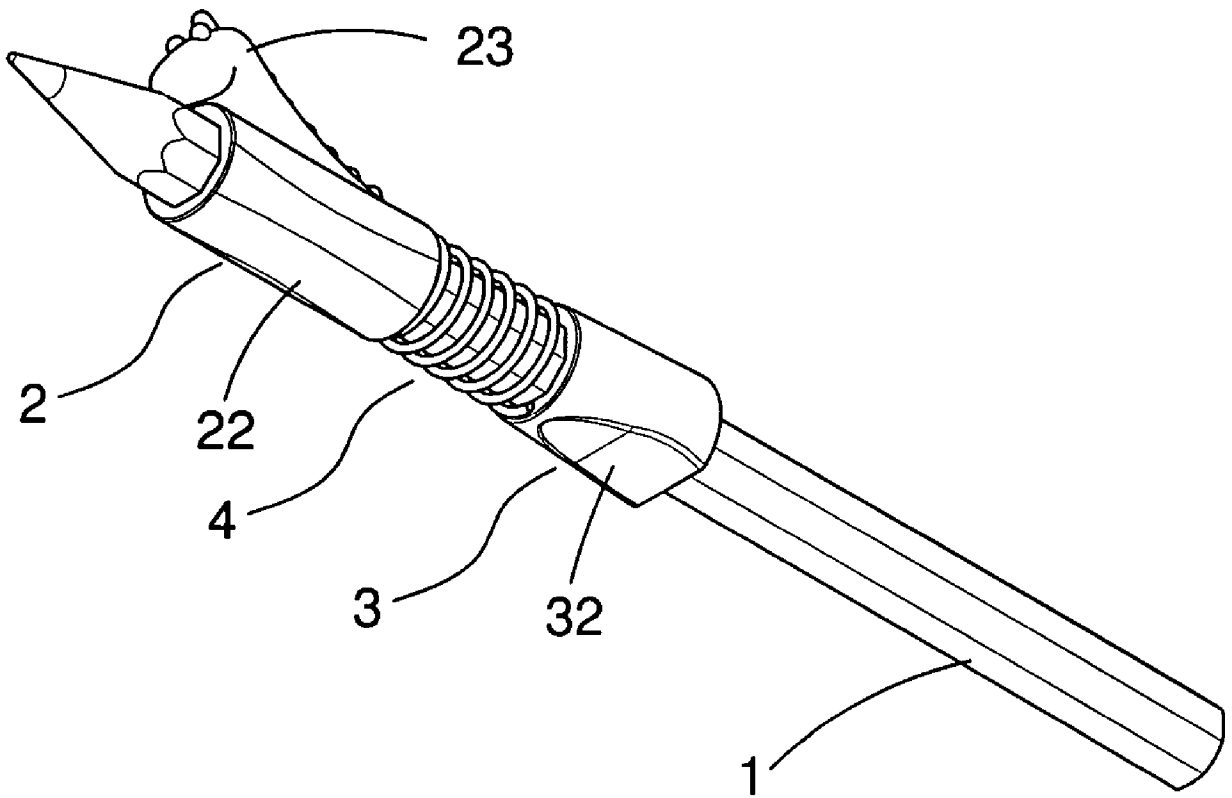
FIG. 3 is another perspective view of the first embodiment.

With reference to FIGS. 1–3, the first embodiment of the present invention discloses an adjustable dual sleeve pen holding auxiliary device for a user to firmly hold a pen. The device mainly comprises a front sleeve 2, a back sleeve 3 and a spiral length adjustable element 4. The front sleeve 2 slidably embraces a shaft 1 of the pen for being placed between finger tips. The back sleeve 3 slidably embraces the shaft 1 of the pen for being placed against a part of the hand between a thumb and an index finger thereof. The spiral length adjustable element 4 surrounds the shaft 1 of the pen and connects the front sleeve 2 with one end and connects the back sleeve 3 with the other end. The front sleeve 2 and back sleeve 3 has through holes 21, 31 therein respectively for the shaft 1 for being put therethrough. The front sleeve 2 and the back sleeve 3 are made of flexible material such as rubber or silica gel. The front sleeve 2 has a first recession 22 thereon for adapting the finger tips and the back sleeve 3 has a second recession 32 thereon for adapting the part of the hand between the thumb and the index finger thereof.

The front sleeve 2 has a first three dimensional configuration 23 and the back sleeve has a second three dimensional configuration 33. The first three dimensional configuration 23 and the second three dimensional configuration 33 together display a unicorn design wherein the first three dimensional configuration 23 represents the front half of a unicorn and the second three dimensional configuration 33 represents the rear half of the unicorn.

Figure 4:
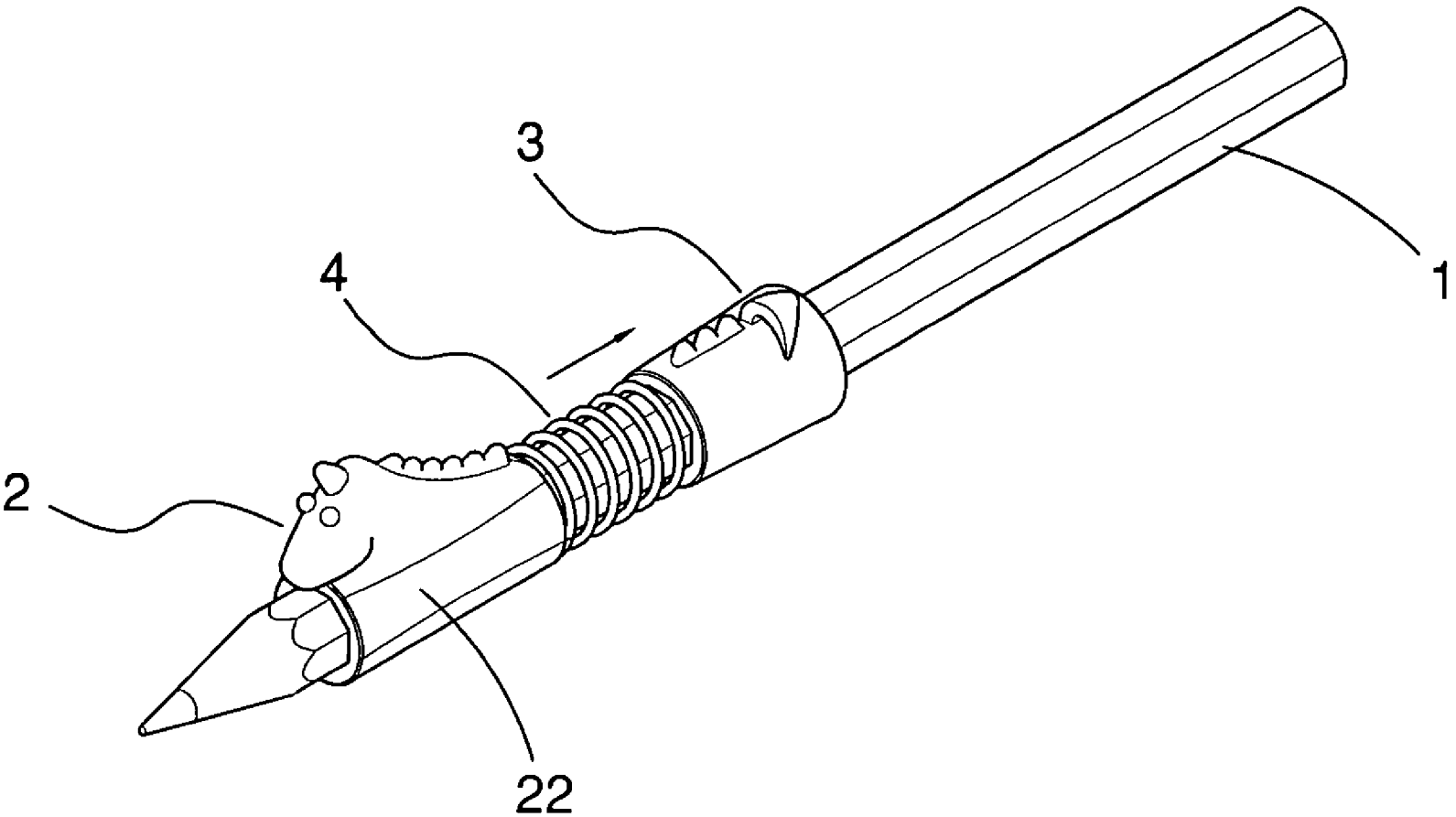
FIG. 4 is a perspective view of the first embodiment illustrating the distance between the front sleeve and the back sleeve is stretched.
Figure 5:
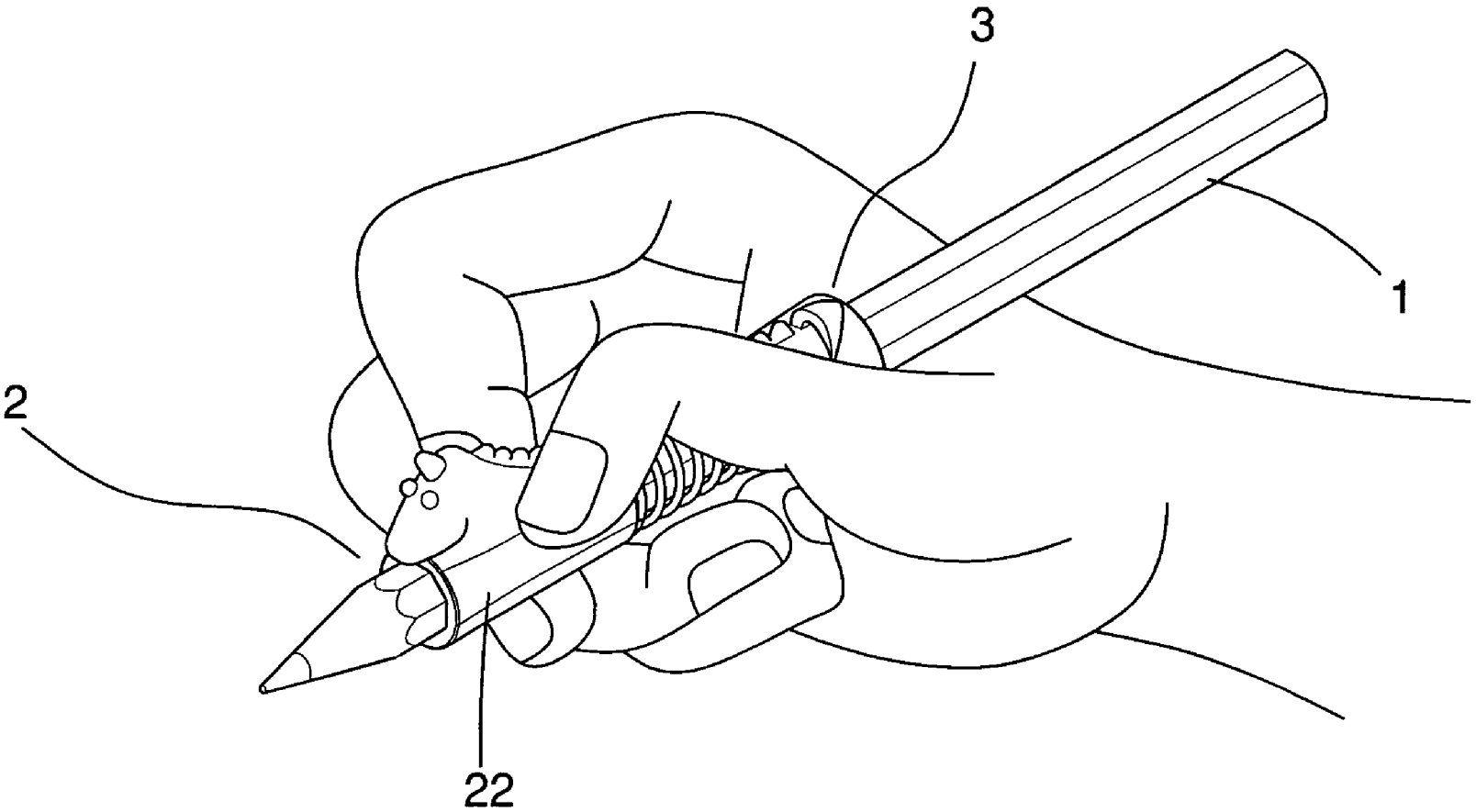
FIG. 5 is a perspective view of the first embodiment illustrating how the first embodiment to be used.

The spiral length adjustable element 4 is stretched or compressed to adjust the distance between the front sleeve 2 and the back sleeve 3. With reference to FIGS. 4 and 5, the spiral length adjustable element 4 is stretched so that the finger tips of the thumb, the middle finger and the middle finger are placed on the first recession 22 of the front sleeve 2 and the part of the hand between the index finger and the thumb is against the second recession 32 of the back sleeve 3. Because the first sleeve 2 and the second sleeve 3 are made of flexible material, the first embodiment provides comfortable touches between the pen and the hand.

Figure 6:
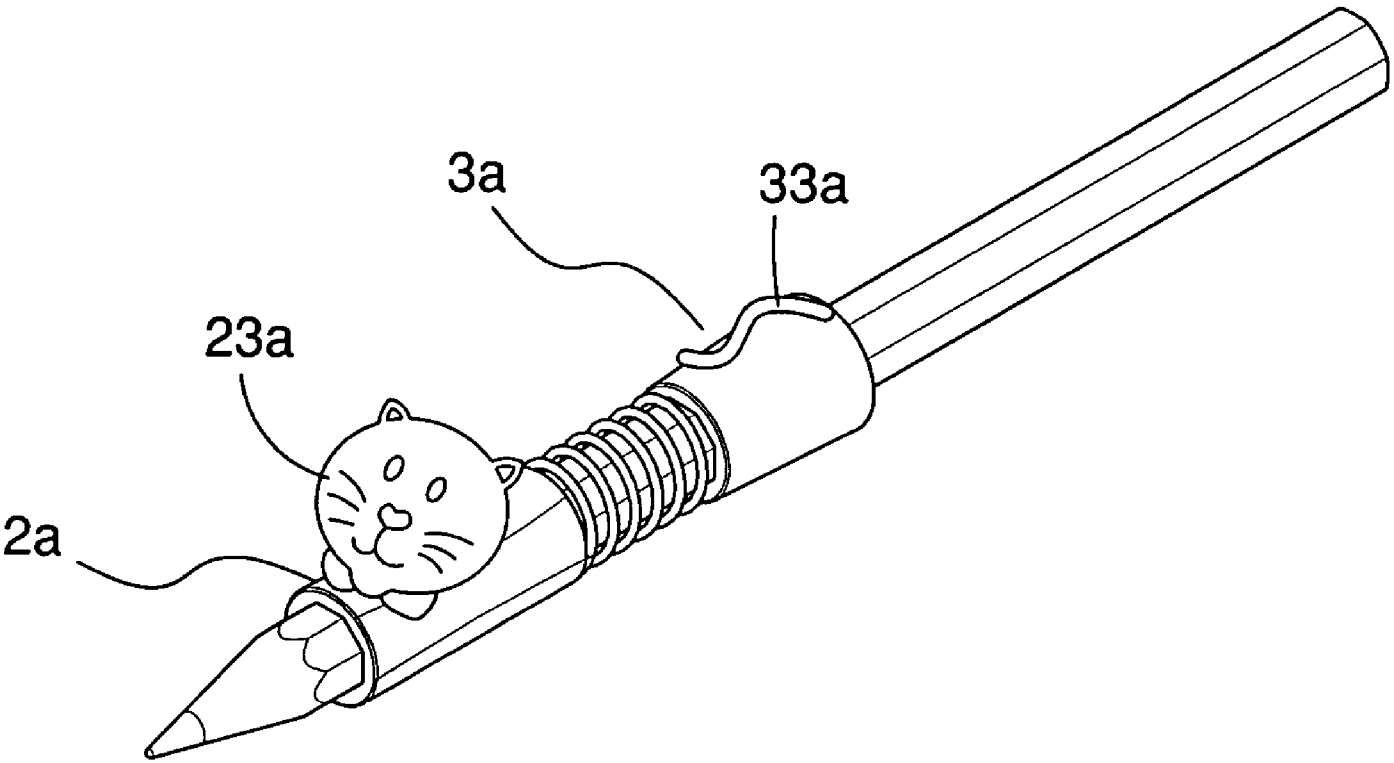
FIG. 6 is a perspective view of the second embodiment having a three dimensional design.

With reference to FIG. 6, the second embodiment of the present invention has all the structures and elements of the first embodiment except that the front sleeve 2*a* and the back sleeve 3*a* together display a three dimensional cat design instead of a unicorn design wherein the first three dimensional configuration 23*a* represents the front half of the cat and the second three dimensional configuration 33*a* represents the rear half of the cat.

Figure 7:
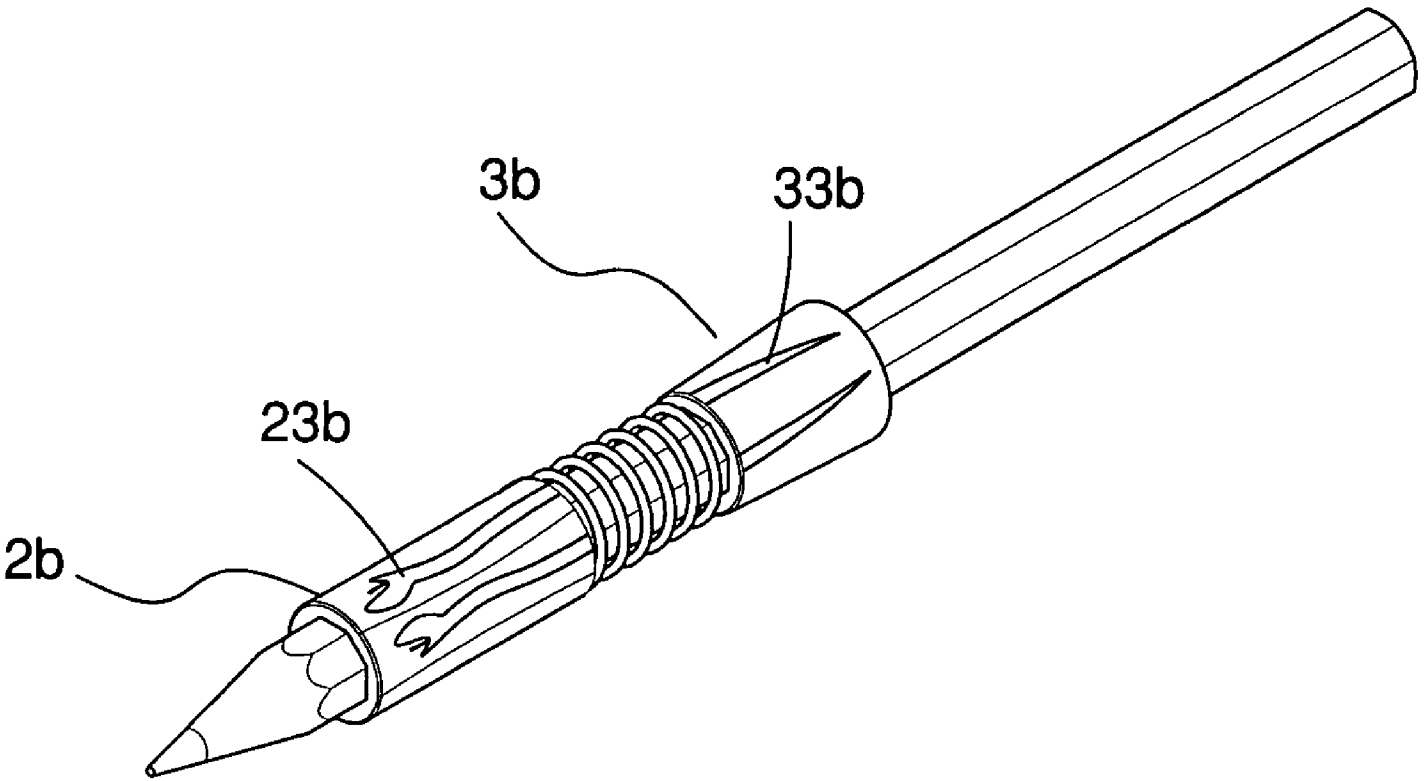
FIG. 7 is a perspective view of the third embodiment having a planar design.

With reference to FIG. 7, the third embodiment of the present invention has all the structures and elements of the first embodiment except that the front sleeve 2*b* has a planar pattern of a front half of a snake 23*b* and the back sleeve 3*b* has a planar pattern of a rear half of the snake 33*b*. The planar patterns of the front half of the snake 23*b* and the pattern of the rear half of the snake 33*b* together display a complete snake.

Figure 8:
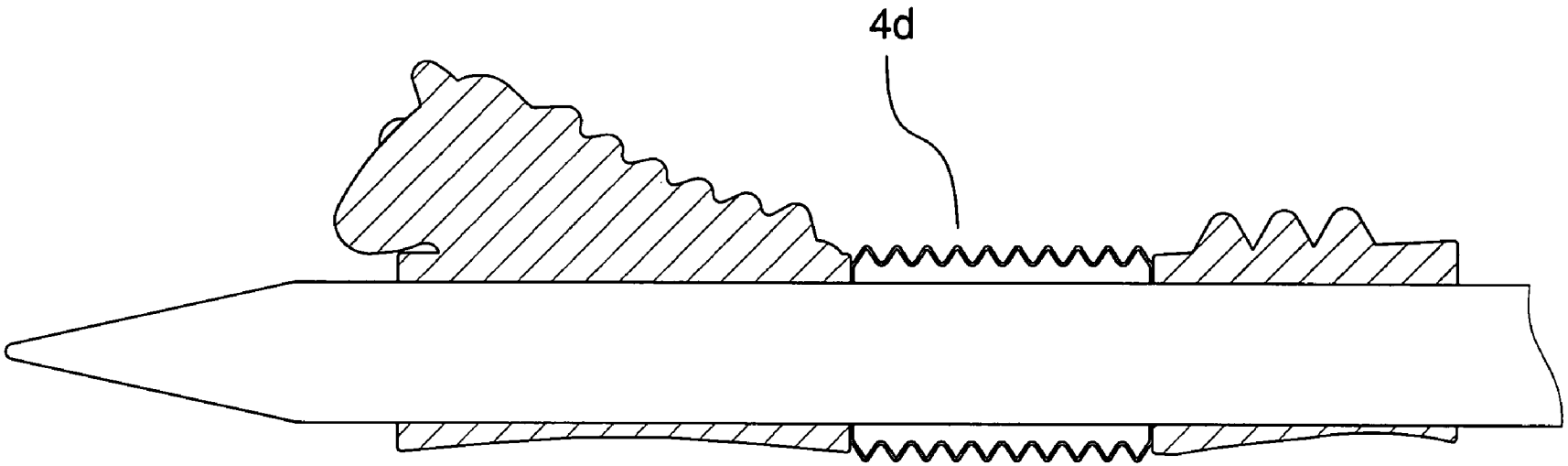
FIG. 8 is a cross sectional view of the fourth embodiment.

With reference to FIG. 8, the fourth embodiment of the present invention, discloses all the structures and elements of the first embodiment except that the length adjustable element is a length adjustable pipe 4*d* instead of a spiral length adjustable element.

Numerous characteristics and advantages of the invention have been set forth in the foregoing description, together with details of the structure and function of the invention, and the novel features thereof are pointed out in appended claims. The disclosure, however, is illustrated only, and changes may be made in detail, especially, in matters of shape, size and arrangement of parts, materials and the combination thereof within the principle of the invention, to the full extent indicated by the broad general meaning of the terms in which the appended claims are expressed.

I claim:

1. An adjustable dual sleeve pen holding auxiliary device for a user to firmly hold a pen, said device comprising;

a front sleeve slidably embracing a shaft of said pen for being placed between finger tips;

a back sleeve slidably embracing said shaft of said pen for being placed against a part of said hand between a thumb and an index finger thereof; and a length adjustable element surrounding said shaft of said pen and connecting said front sleeve with one end and connecting said back sleeve with the other end, wherein said back sleeve has a recession thereon for adapting said part of said hand between said thumb and said index finger thereof.

2. An adjustable dual sleeve pen holding auxiliary device for a user to firmly hold a pen, said device comprising:

a front sleeve slidably embracing a shaft of said pen for being placed between finger tips;

a back sleeve slidably embracing said shaft of said pen for being placed against a part of said hand between a thumb and an index finger thereof; and a length adjustable element surrounding said shaft of said pen and connecting said front sleeve with one end and connecting said back sleeve with the other end, wherein said length adjustable element is a spiral length adjustable element.

3. The device of claim 2 wherein said front sleeve has a first three dimensional configuration and said back sleeve has a second three dimensional configuration, said first three dimensional configuration and said second three dimensional configuration together displaying a special three dimensional design.

4. The device of claim 3 wherein said front sleeve and said back sleeve are made of rubber.

5. The device of claim 2 wherein said front sleeve has a first pattern and said back sleeve has a second pattern, said first pattern and said second pattern together displaying a special planar design.

6. An adjustable dual sleeve pen holding auxiliary device for a user to firmly hold a pen, said device comprising:

a front sleeve slidably embracing a shaft of said pen for being placed between finger tips, wherein said front sleeve has a recession thereon for adapting said finger tips;

a back sleeve slidably embracing said shaft of said pen for being placed against a part of said hand between a thumb and an index finger thereof; and a length adjustable element surrounding said shaft of said pen and connecting said front sleeve with one end and connecting said back sleeve with the other end, wherein said back sleeve has a second recession thereon for adapting said part of said hand between said thumb and said index finger thereof.

7. The device of claim 6 wherein said length adjustable element is a spiral length adjustable element.

8. The device of claim 7 wherein said front sleeve has a first three dimensional configuration and said back sleeve has a second three dimensional configuration, said first three dimensional configuration and said second three dimensional configuration together displaying a special three dimensional design.

9. The device of claim 7 wherein said front sleeve has a first pattern and said back sleeve has a second pattern, said first pattern and said second pattern together displaying a special planar design.

10. The device of claim 6 wherein said length adjustable element is a length adjustable pipe.

11. The device of claim 10 wherein said front sleeve has a first three dimensional configuration and said back sleeve has a second three dimensional configuration, said first three dimensional configuration and said second three dimensional configuration together displaying a special three dimensional design.

12. The device of claim 10 wherein said front sleeve has a first pattern and said back sleeve has a second pattern, said first pattern and said second pattern together displaying a special planar design.

* * * * *